US005652598A

United States Patent [19]

Campbell et al.

[11] Patent Number: 5,652,598

[45] Date of Patent: Jul. 29, 1997

[54] CHARGE COLLECTOR EQUIPPED, OPEN-SLEEVE ANTENNAS

[75] Inventors: Donn V. Campbell; Carlton H. Walter, both of Poway; Robert V. DeVore, Ramona, all of Calif.

[73] Assignee: TRW, Inc., Redondo Beach, Calif.

[21] Appl. No.: 603,379

[22] Filed: Feb. 20, 1996

[51] Int. Cl.[6] ..... H01Q 9/04

[52] U.S. Cl. ..... 343/791; 343/792; 343/752; 343/860

[58] Field of Search ..... 343/752, 828, 343/830, 797, 791, 790, 792, 860, 861, 749, 750; H01Q 9/04

[56] References Cited

U.S. PATENT DOCUMENTS

| | | | |
|---|---|---|---|
| 2,913,722 | 11/1959 | Brueckmann | 343/724 |
| 3,100,893 | 8/1963 | Brueckmann | 343/713 |
| 3,750,181 | 7/1973 | Kuecken | 343/790 |
| 3,765,022 | 10/1973 | Tanner | 343/792.5 |
| 3,899,787 | 8/1975 | Czerwinski | 343/790 |
| 3,961,331 | 6/1976 | Campbell | 343/885 |
| 3,967,276 | 6/1976 | Goubau | 343/752 |
| 4,097,867 | 6/1978 | Eroncig | 343/715 |
| 4,313,121 | 1/1982 | Campbell et al. | 343/790 |
| 4,359,743 | 11/1982 | DeSantis | 343/792 |
| 4,369,449 | 1/1983 | MacDougall | 343/790 |
| 4,498,086 | 2/1985 | Sandler | 343/807 |
| 4,604,628 | 8/1986 | Cox | 343/818 |
| 4,789,869 | 12/1988 | Aslan | 343/801 |
| 4,812,855 | 3/1989 | Coe et al. | 343/818 |
| 4,829,311 | 5/1989 | Wells | 343/749 |
| 4,860,020 | 8/1989 | Wong et al. | 343/828 |
| 4,940,989 | 7/1990 | Austin | 343/749 |
| 5,061,944 | 10/1991 | Powers et al. | 343/795 |
| 5,231,412 | 7/1993 | Eberhardt et al. | 343/790 |

*Primary Examiner*—Hoanganh T. Le
*Attorney, Agent, or Firm*—Michael S. Yatsko

[57] ABSTRACT

In the preferred embodiment of the invention, a broadband dipole antenna 10 for transmitting and receiving electromagnetic energy constructed of coaxially aligned radiating elements 14 and 16 is provided. Each of the radiating elements 14 and 16 has a charge collector 40 and 42 affixed to its free end, that function to collect charges forming a current sink for collecting the current generated by the radiating elements. Coupled with the radiating elements is an isolation choke 44 to isolate the radiating elements against electrical disturbances caused by the antenna support platform 130 and 138 effecting a match of the impedance between the radiating elements and the transmission lives. Another preferred embodiment is a monopole 86 equipped with a charge collector 96. The dipole 10 and monopole 86 are provided pairs of open-sleeves 28 and 26 and 92 and 94 to enhance the instantaneous bandwidth of the radiating elements.

12 Claims, 9 Drawing Sheets

GROUND OPEN-SLEEVE END-LOADED DIPOLE 60.0000MHz

GROUND COMMAND-CONTROL VEHICLE 60.0000MHz

OPEN-SLEEVE END-LOADED DIPOLE 12" ABOVE GROUND (OSDIP)

GAIN AT HORIZON VS. FREQUENCY
END-LOADED BASE-ISOLATED OPEN-SLEEVE DIPOLE

LOADED OPEN-SLEEVE MONOPOLE:GAIN AT HORIZON VS. FREQUENCY

GAIN AT HORIZON VS. FREQUENCY
TOP-LOADED OPEN-SLEEVE MONOPLOE

IMPEDENCE OF END-LOADED BASE-ISOLATED OPEN-SLEEVE DIPOLE

IMPEDENCE OF TOP-LOADED OPEN-SLEEVE MONOPOLE

CHARGE COLLECTOR EQUIPPED, OPEN-SLEEVE ANTENNAS

TECHNICAL FIELD

This invention relates generally to broadband antennas and more particularly, to sleeve type charge collector equipped dipole and monopole antennas.

BACKGROUND

The ready availability of integrated circuits has made possible the manufacture of extremely compact broadband radios. The widespread use and availability of such compact radios has created a need for physically small broadband antennas, especially where very high frequency (VHF) transmission and reception is involved.

The military have a particular and special need for smaller size broadband antennas than are generally available for VHF applications.

Size reduction of broadband antennas has not been fully realized because of the dilemma posed by the dictates of the size relationship between fundamental antenna gain and bandwidth limitations. Smaller broadband antennas experience reduced gain and narrowed instantaneous bandwidth unless they are equipped with complicated tuning devices which of necessity increases their size.

The advent of spread-spectrum radios, such as Sincgars, has further extended the need for low profile rugged antennas for military use in portable radio equipment (manpack) as well as vehicular radio communications. This type of VHF communication must be capable of operating in a frequency-hopping mode over a 3 to 1 frequency range. Another drawback of current broadband antenna designs involves the mounting on vehicles which could adversely modify the antenna impedance from its normal value because of the electrical disturbances due to the excitation of currents on the vehicle. This also causes a change in the shape of the radiation pattern such as undesirable ripples as opposed to desired uniform patterns.

One of the important considerations in the design of an antenna is the maintenance of an appropriate input impedance to the broadband antennas of the type to which this invention is directed. It is most important to the transfer of power from the transmitter to the antenna or from an antenna to a receiver. To maximize the power transfer between the antenna and a transmitter or receiver, the antenna impedance should be a conjugate match. A conjugate match defines equal resistances and equal magnitude and oppositely signed reactances. Typically, the receiver (or transmitter) has a real impedance so it is necessary to negate ("tune out") the antenna reactance with a matching network of variable inductances and capacitances to cancel antenna reactances.

Designers of antennas have experienced disadvantages with antenna impedance matching networks. It has been found that such matching networks are inefficient because of ohmic losses in tuning coils and the matching network has been found to perform over a relatively narrow band of frequencies. This problem of course reduces the operational bandwidth, which is an undesirable result. The problems resulting from a mismatch at the antenna results in setting up reflections along the transmission line causing the voltage standing wave ratio ("VSWR") to be much greater than unity. The VSWR defines the range of frequencies for which performance of the antenna conforms to a specific standard. For example, the VSWR desirably is less than 3 to 1.

Certain prior art patents involving the use of matching networks controlling the impedance in broadband vertical antennas deserve discussion. Such innovation is disclosed in two U.S. patents, U.S. Pat. No. 2,913,722 and U.S. Pat. No. 3,100,893, both issued to Helmut Brueckmann. Brueckmann teaches the use of isolation chokes which may or may not use ferrite cores. Brueckmann's chokes are adjustable in stepped increments by switching a tapped shunt inductance coil. The incremental step adjustments are based on the node position of the current distribution along the antenna. To improve the impedance match this prior art varied the node position of the current distribution. These adjustments degraded the effectiveness of the base-isolation feature. These prior art antennas being dual-feed type require that the feed point be at the base of the antenna for low frequencies. The feed point is switched to the center feed for higher frequencies. In order to cover a broadband, the teaching of these prior art patents requires switching at least 10 sub-bands to achieve the range of 20 to 70 MHz.

It is therefore a primary object of the present invention to provide a broadband VHF antenna that is smaller in size and of rugged construction and provides a low VSWR over a 3 to 1 frequency range.

It is another object of this invention to provide a broadband VHF antenna that can be mounted on fixed or mobile support platforms with the antenna having reduced physical height, improved input impedance, increased effective electrical height and providing a low VSWR over a broad frequency range.

SUMMARY

The invention resides in a broadband antenna capable of transmitting and receiving electromagnetic signals to and from stationary or mobile support platforms over a broad, very high frequency ("VHF") range, employing charge collectors at the ends of the dipole or the top of the monopole radiating elements and equipped with sleeve means for enhancing the instantaneous bandwidth of said radiating elements. The dipole antenna is equipped with isolation choke means for providing high impedance values with respect to ground. The choke is coupled to the radiating elements and is connected between the dipole antenna and the ground and provides isolation over the frequency range of the antenna. The isolation choke construction is such that it electrically establishes an appropriate inductance L with a capacitance C that relate to the self-resonance frequencies according to the following mathematical relationship:

$$f_o = \frac{1}{2\pi\sqrt{LC}} \qquad \text{EQ. 1}$$

The isolation choke impedance is very high under conditions when the self-resonance frequency equals the operating frequency. The relationship of series effective resistance "Re" and series effective reactance "$X_e$" are represented by the following mathematical approximations:

$$R_e \approx \frac{R}{\left[1-\left(\frac{f}{f_o}\right)^2\right]^2} \qquad \text{EQ. 2}$$

And $$X_e \approx \frac{2\pi fL}{1-\left[\frac{f}{f_o}\right]^2} \qquad \text{EQ. 3}$$

In the foregoing equations the various values are represented as follows:

L=inductance of the choke

C=capacitance of the choke f=operational frequency $f_o$=self-resonating frequency R=ohmic losses of the isolation choke $R_e$=resistance $X_e$=reactance Construction of the radiating elements with charge collectors is structurally accomplished by affixing a conductive member or members to the free ends of the dipole or the top of the monopole. Such charge collectors are sometimes referred to as end-loading or top-loading the antennas. Such conductive member may be a series of wires extending radially outward from the end of the antenna. The charge collector can be a flat or shaped disk, wire mesh screen or any configuration that forms a charge collector in the form of a conductive umbrella-like structure that lies generally in a plane perpendicular to the radiating element.

DRAWINGS

These and other features, aspects, and advantages of the present invention will become better understood from the following description, appended claims, and accompanying drawings:

DESCRIPTION

Figure 1:
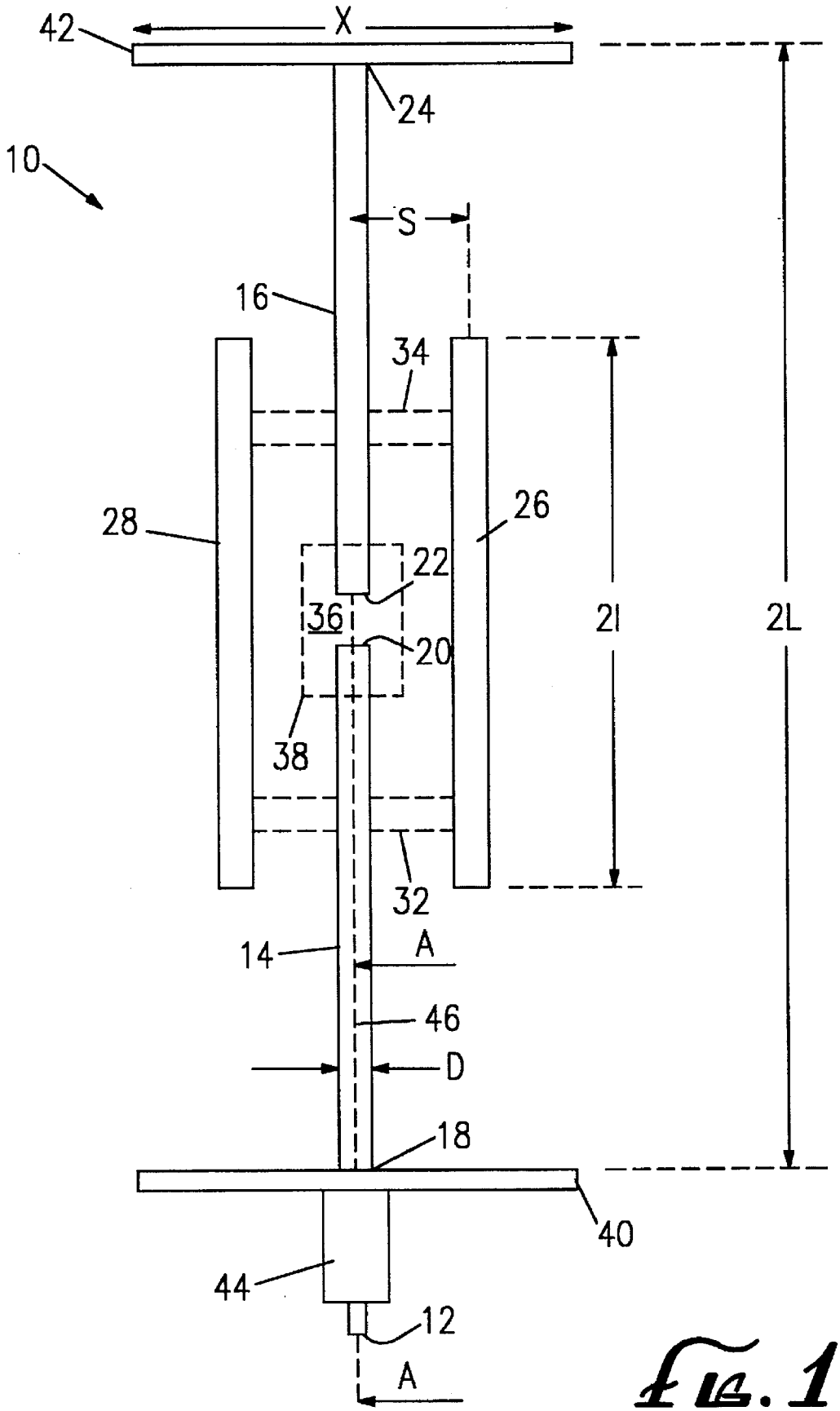
FIG. 1 is a simplified sketch of a base isolated end-loaded open-sleeve dipole antenna with an isolation choke.

Turning now to the drawings and referring first to FIG. 1 there is shown an open sleeve dipole antenna 10 which is equipped with an RF connector 12. Two axially aligned tubular radiating elements, the lower radiating element 14 and an upper radiating element 16, which form the dipole antenna. A lower radiating element 14 has end portions 18 and top end portion 20 and the upper radiating element 16 similarly has a bottom end portion 22 and a top end portion 24. A pair of cylindrically shaped segments form sleeve elements 26 and 28 which partially encircle the dipole radiating elements 14 and 16 being parallel to the radiating elements and are spaced apart from the radiating elements by dielectric supports 32 and 34. The sleeve elements cover the end portions 20 and 22 and extend axially partway along the radiating element 14 and 16. The partial circumferential encirclement of the dipole elements 14 and 16 about the end portions 20 and 22 and extending partway axially along each dipole constitutes an open-sleeve construction which is well-known in the art.

The end portions 20 and 22 of the lower and upper dipole elements, respectively, are spaced apart and axially aligned. The spaced apart portion 36 is the feed point centrally located for the antenna 10. The center feed location 36 is formed by a dielectric connector 38. The antenna is characterized as being end-loaded with conductive elements 40 and 42 being affixed to the end portions 18 and 24, respectively.

The charge collectors 40 and 42 are formed of metal and can be configured in the form of radially extending wires emanating from the end portions 18 and 24. The charge collectors could also be in the form of a solid disc or wire mesh screen and can acquire a range of different geometric configurations such as square, triangular, or circular configuration. The primary function of the end-loading is to serve as an umbrella-like charge collector, and the make-up of the umbrella, whether of screen wires or discs, is not critical as well as its particular geometry.

Figure 2:
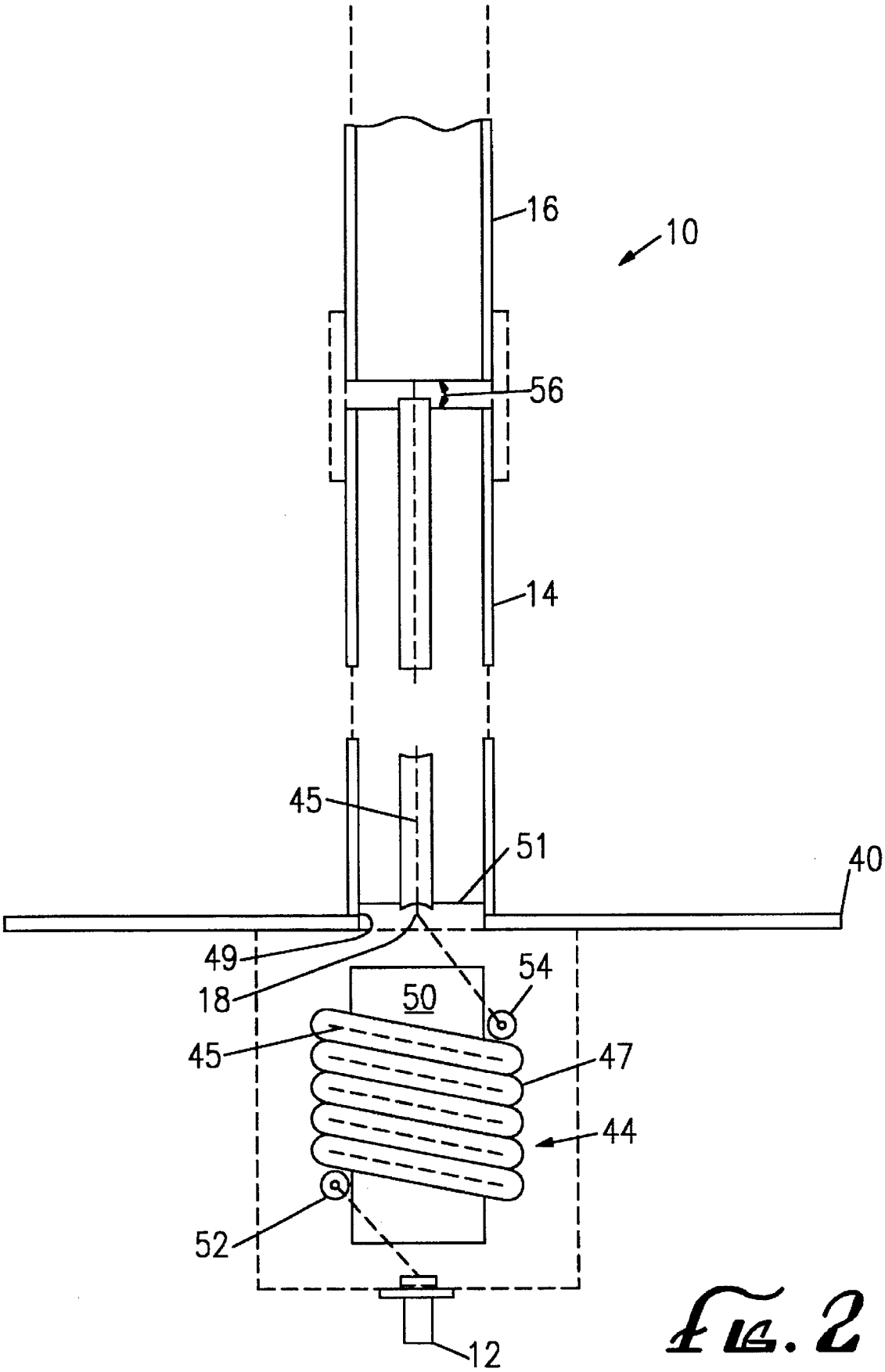
FIG. 2 is a cross-section along A—A of FIG. 1 showing the cable choke connections and open-sleeve dipole antenna and feed point.

An essential feature of the antenna 10 is the isolation choke 44. The coaxial cable 46 is constructed of an outer shield 47 and inner conductor 45. Referring to FIG. 2, the shield 47 is connected at 51 to the charge collector 40. The coaxial cable 46 continues into the opening 49 and the shield 47 connects to the lower radiating element 14 at its free end 18. The inner conductor 45 and shield 47 continues through the radiating element 14 and into the radiating element 16 where the inner conductor 45 connects to the free end 22 and the shield 47 connects to end portion 20 (FIG. 1).

FIG. 2 is an enlarged cross-section of the bottom charge collector portion 40 of the radiating element 14 and the load 40. The isolation choke 44 is comprised of a ferrite core or rod 50 around which is coiled the coaxial cable 46 having a lower connector end 52 and an upper connector end 54. The bottom connector end 52 is connected to the rf connector 12 and the upper connector end 54 is fed into the bottom end 18 of the lower tubular dipole element. The inner conductor 45 of the coaxial cable 46 connects to end 22 of the upper element at the center feed point 36 (FIG. 1) and the shield connects to end portion 20 of the lower tubular dipole element.

Figure 3:
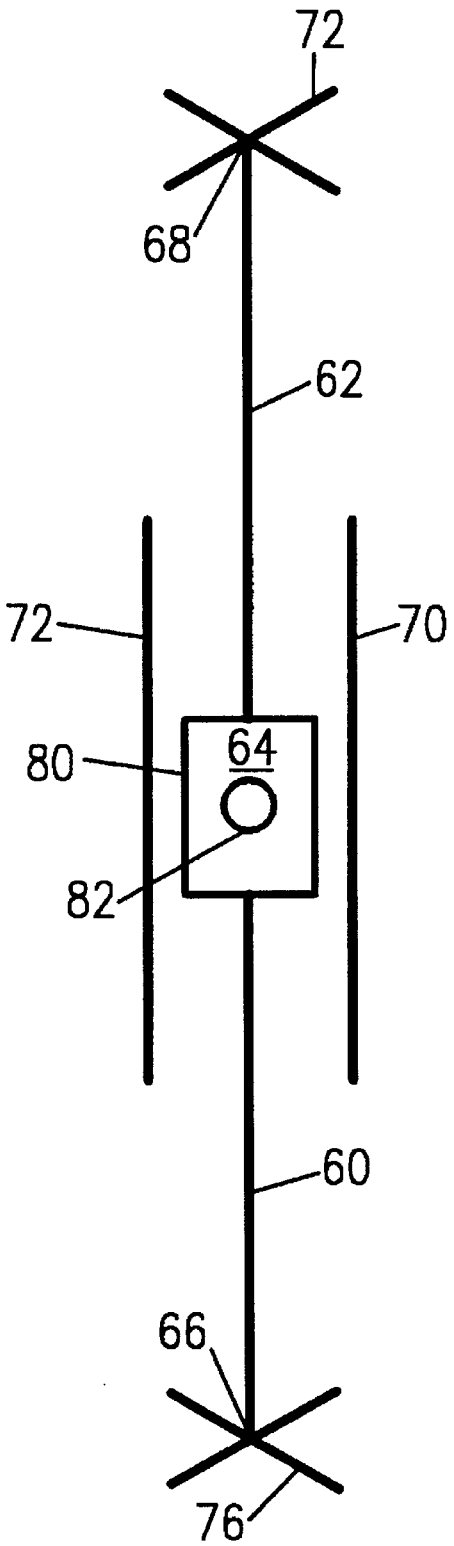
FIG. 3 is a simplified drawing of an open-sleeve dipole, with charge collectors at the ends of the dipole antenna in which the isolation choke and feed point are coincident at a central location.

FIG. 3 is another embodiment of the dipole antenna of this invention in which the isolation choke and feed point are located at the center of the dipole. The charge collector at the end of the dipole antenna is of the same general construction as described in connection with the dipole antenna shown in FIG. 1. A pair of tubular radiating elements 60 and 62 are coaxially aligned and arranged in spaced apart relationship forming a center location 64. The lower and upper elements each have free end portions 66 and 68. A pair of open-sleeve members 70 and 72 are formed of longitudinal cylinder sections that partially encircle the axially aligned radiating elements adjacent the center location 64. The open-sleeve members 70 and 72 are radially spaced apart from the pair of radiating elements 60 and 62 and the encirclement extends parallel to the pair of radiating elements 60 and 62 leaving a section of each of the radiating elements with the free ends exposed outside the sleeves. Attached to each of the free ends 66 and 68 are conductive loads 76 and 78, respectively. The conductive loads are of the same general construction as described in connection with FIG. 1;

The isolation choke 80 is located coincident with and connected to the input connector 82 and both are found at the center location 64.

Figure 4:
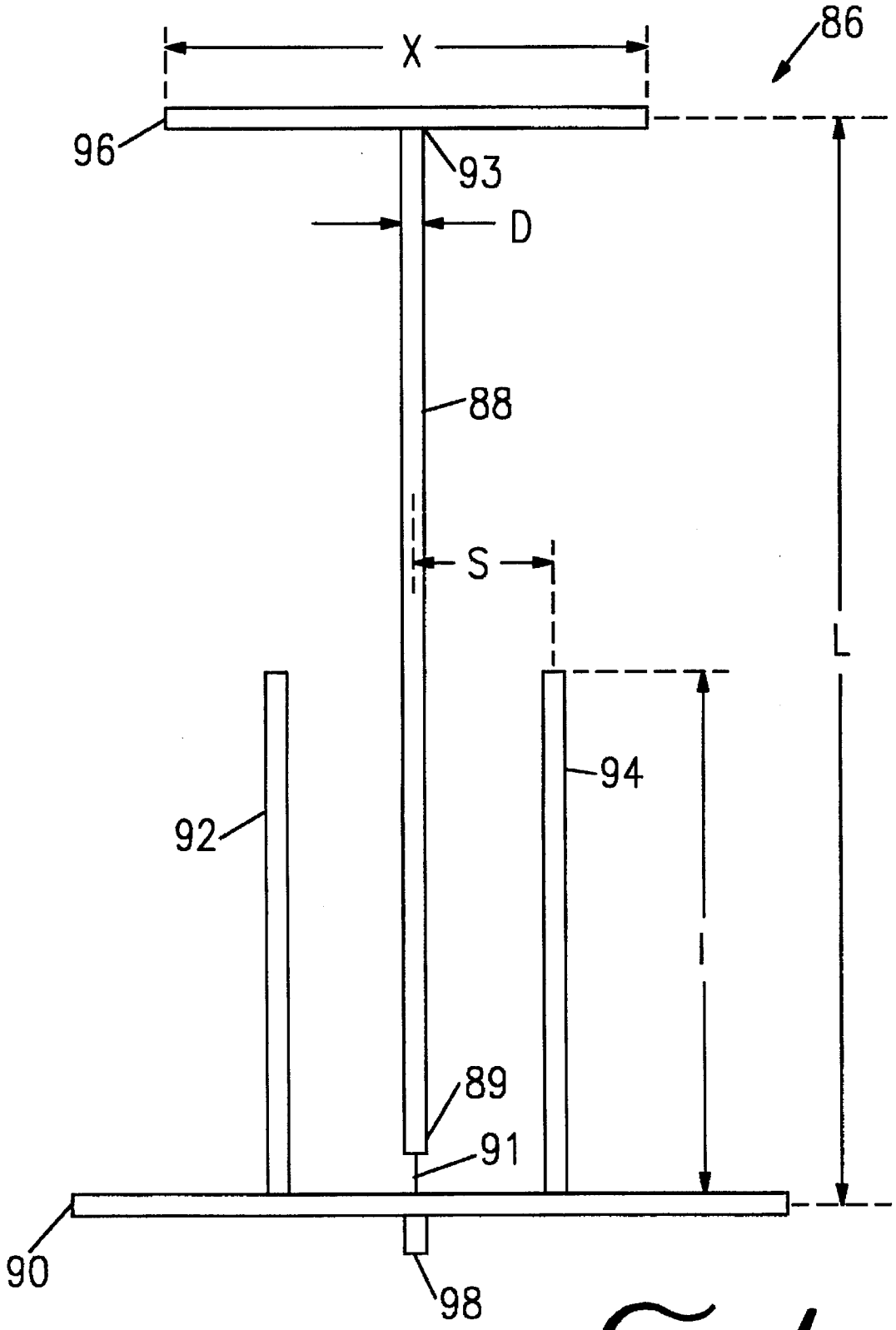
FIG. 4 is a simplified sketch of a charge collector equipped, open-sleeve monopole antenna.

Another embodiment of this invention is the charge collector equipped, open-sleeve monopole antenna 86 shown in FIG. 4. The antenna is constructed of a single tubular radiating element 88 having a lower end 89 which connects to the pin 91 that couples the radiating element to the rf connector 98. The rf connector is affixed to ground platform 90. A feed coax cable (not shown) feeds the signals from the radio transceiver and is connected to the rf connector 98.

A pair of sleeve members 92 and 94 formed of longitudinal sections of a cylinder circumferentially encircle the radiating element running parallel to the element 88 but in spaced apart relationship therefrom. The sleeve members are fixed to the mounting plate 90 and extend partway along the length of the element 88. At the top free end 93 there is attached the charge collector 96 which is constructed of conductive wire or the like, which is similar to the charge collector described in connection with FIG. 1. At the bottom of the plate 90 there is provided an rf connector 98. The rf connector 98 serves to receive the feed cable from the radio transceiver. The center conductor of the feed extends into the tubular portion of the radiating element 89 and is connected to the pin 91 of the rf connector 98. The charge collector 96 is affixed to the radiating element 88 represents an important feature of the monopole invention. The charge collector may take the form of a solid metal disc, a wire mesh screen, or individual wires radiating from the top of the radiating element which serve to form a charge-collecting umbrella for the antenna. The charge collector 96 serves as a sink for the collection of current which has been found to greatly increase the bandwidth of the antenna.

Figure 5:
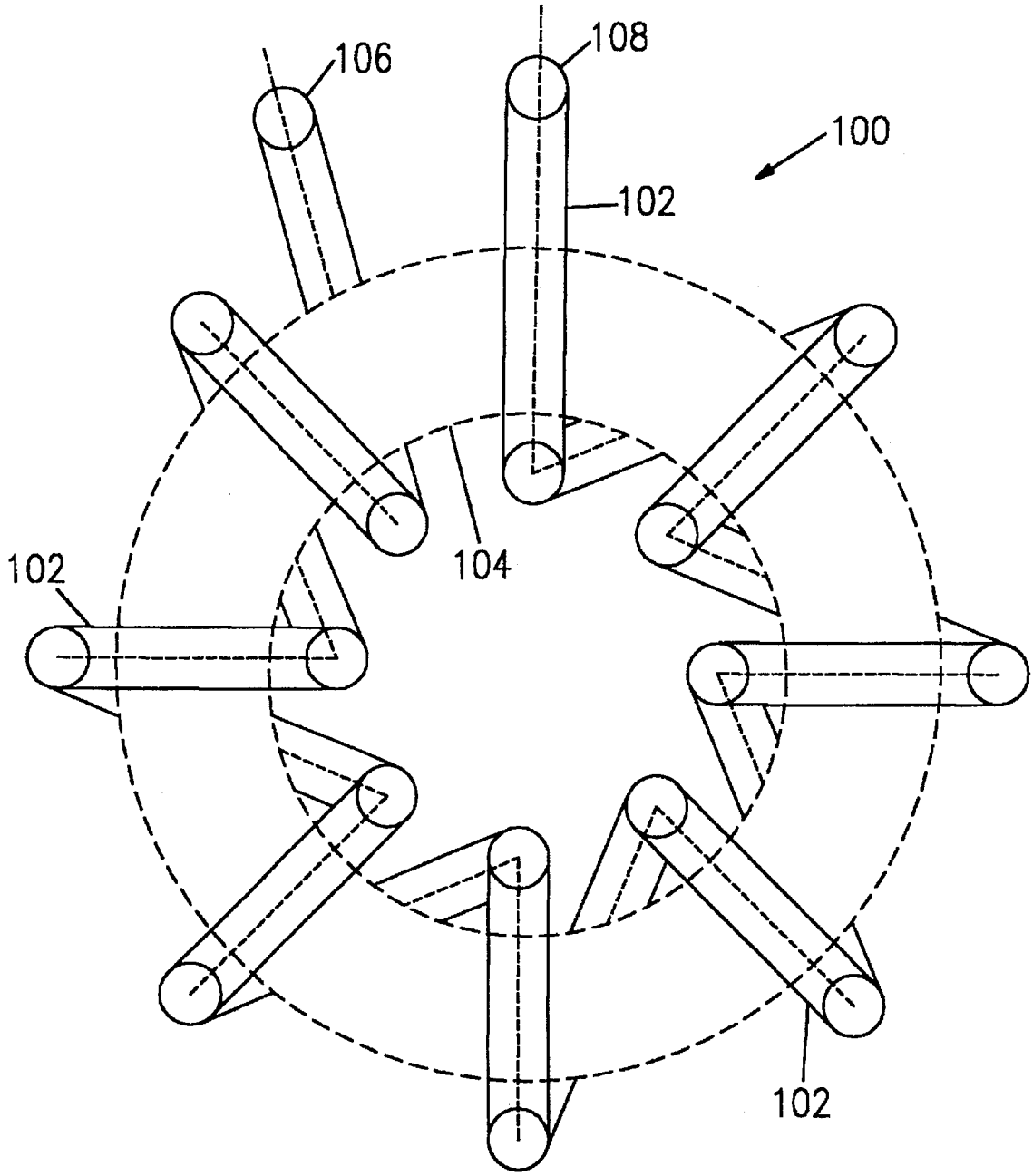
FIG. 5 is a simplified plan view of a cable choke wound on a toroidal ferrite core.

Referring now to FIG. 5, there is shown the isolation choke 100 that is useful with the end-loaded dipole antennas of this invention. In constructing such isolation choke, a continuous strand of coaxial cable 102 is wound around a toroidal shaped ferrite core 104 starting with the lead end 106 of the coaxial cable 102. The lead end 106 is connected to the rf connector 12 of FIG. 1 or the input connection 82 of FIG. 3.

Figure 6:
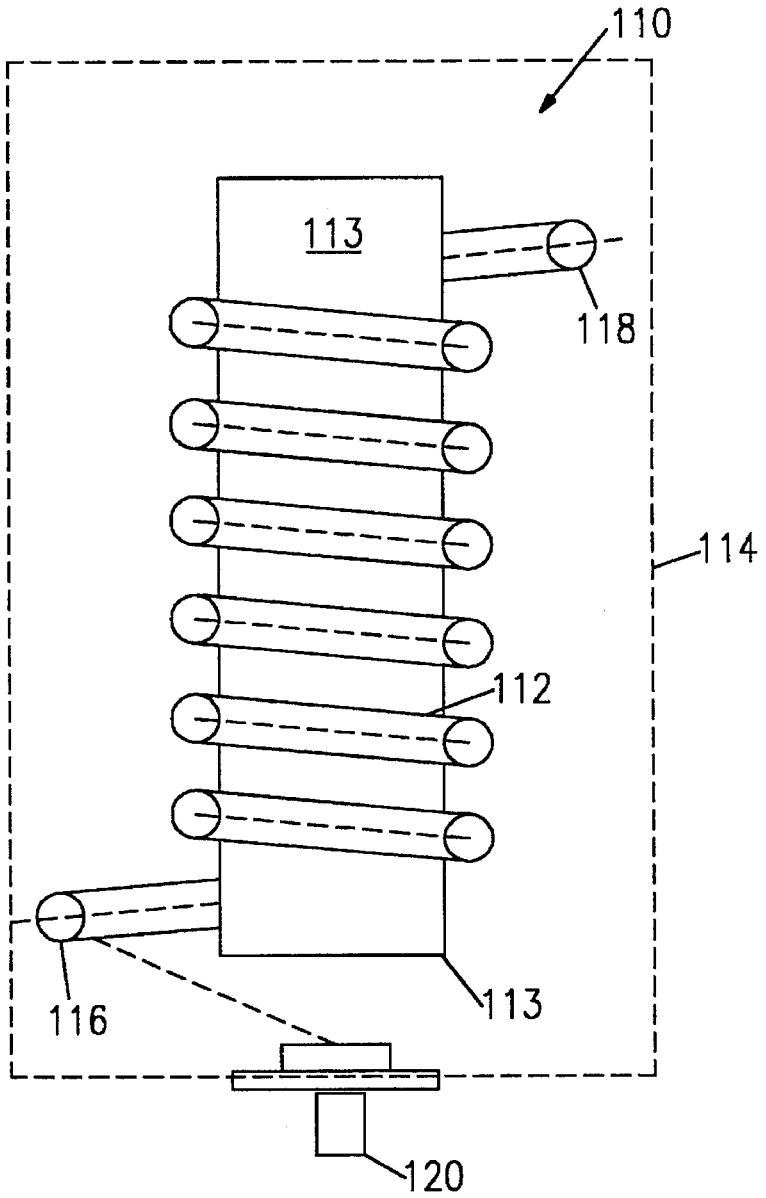
FIG. 6 is an elevation view of a cable choke solenoidal winding on a ferrite core.

Turning now to FIG. 6, there is shown in elevation a view of the isolation choke 110 which is formed by a solenoidal winding of coax cable 112 about a ferrite core 113. The isolation choke is protected by a dielectric fiberglass housing 114. The strand of coax cable 112 has a lead end 116 and a dipole connecting end 118. The lead end 116 is connected to the rf connector 120 located at the bottom of the antenna as shown in FIG. 1, and at the center location of the construction in the case of FIG. 3. Referring again to FIG. 1, the dipole connector end 118 is connected via coaxial cable 46 to the feed point 36 of the dipole antenna 10 as discussed hereinabove. Again, in the case of FIG. 1 and FIG. 2, the feed point is at the center 36 and 56, respectively.

In a working example of the antenna shown in FIG. 1, the radiating elements 14 and 16 have an outside diameter of 1.5 inches. As shown in FIG. 1, the value L is 64 inches. The combined length of the radiating elements 14 and 16 is 128 inches. The length of the sleeves is 64 inches (2 l) and the radial distance from the center of the radiating elements to the center of the sleeve is 5 inches. The charge-collecting umbrella, or the load elements, are 16 inches long and can be fabricated using heavy gauge wire or metal tubing.

The design objectives for the isolation chokes described herein and as shown in FIGS. 5 and 6 is to provide a sufficiently high impedance to suppress rf current at the bottom of the antenna. The chokes shown in FIGS. 5 and 6 are self-resonating at a mid-band frequency, and they provide high impedance over a broad frequency range. To accomplish these objectives the choke has a large inductance and a low value for self-capacitance. Large inductance is obtained by winding the coaxial cable on a high permeability, low loss ferrite core, such as a rod or toroid. Self-capacitance is minimized by appropriately spacing the windings and using small diameter coaxial cable.

The isolation choke such as, for example, in FIGS. 5 and 6, are designed to resonate at the geometric mean frequency. The reactance of the isolation choke at lower operating frequencies will be equal and opposite to its reactance at the upper operating frequency.

The following mathematical equations for the choke determine the levels of inductance and capacitance necessary to achieve the desired reactance.

$$L=\frac{X}{2\pi}\cdot\frac{f_2-f_1}{f_1\cdot f_2} \qquad \text{EQ. 4}$$

$$C=\frac{1}{2\pi X(f_2-f_1)} \qquad \text{EQ. 5}$$

The choke reactance will be equal to X at frequency $f_1$ and −X at frequency $f_2$.

Figure 7:
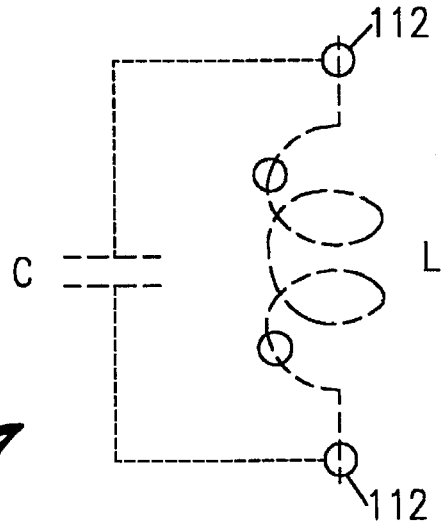
FIG. 7 is a schematic showing the equivalent electrical circuit of the isolation choke of this invention.

By way of a working example, the isolation choke 100 (FIG. 5) has a reactance of more than 1000 ohms over the frequency range of 30 MHz to 88 MHz. The cable windings are made of a miniature 50 ohm coaxial cable identified as RG-196. The coaxial cable is wound on a toroid-shaped core which has an outside diameter of 1.25 inches and an inside diameter of 0.75 inches and is 0.75 inches thick. The relative permeability μr of the core is equal to 40. The equivalent circuit of the working example that represents the mathematical equations 1, 2 and 3 is shown in FIG. 7.

Figure 8:
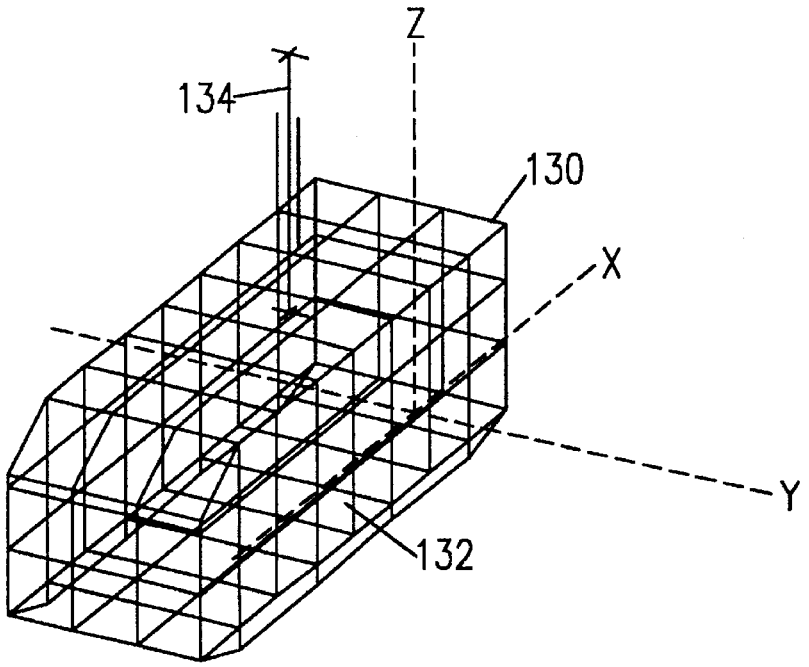
FIG. 8 is a perspective view of the antenna shown in FIG. 1 mounted on a wire grid model of a vehicle.

Utilization of the dipole antenna of this invention on a mobile unit is illustrated in FIG. 8 in which the vehicle 130, represented by a conductive wire grid 132, serves as a mounting base for the antenna. The dipole antenna 134 is end-loaded and open-sleeve construction. The operating frequency range is 30–88 MHz.

Figure 9:
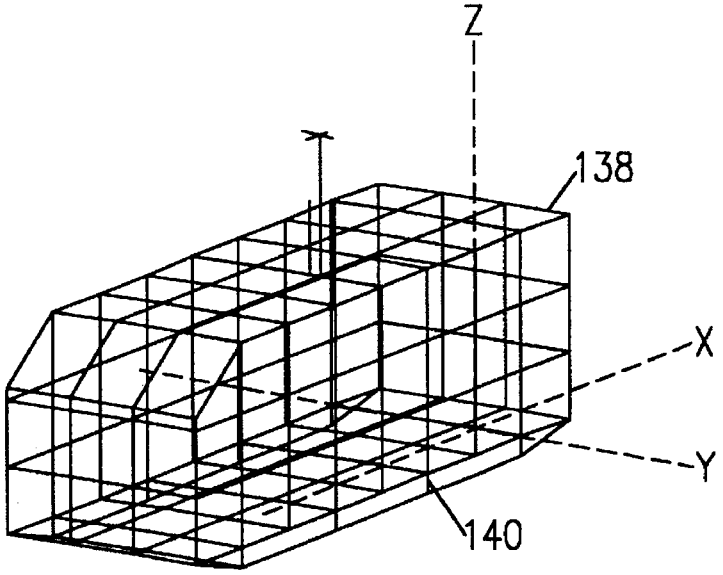
FIG. 9 is a perspective view of the antenna shown in FIG. 4 mounted on a wire grid model of a vehicle.

FIG. 9 illustrates utilization of an open-sleeve, top-loaded monopole antenna 136 mounted on a mobile unit 138 represented by a wire grid structure 140. The operating frequency range is 30–88 MHz.

Figure 10:
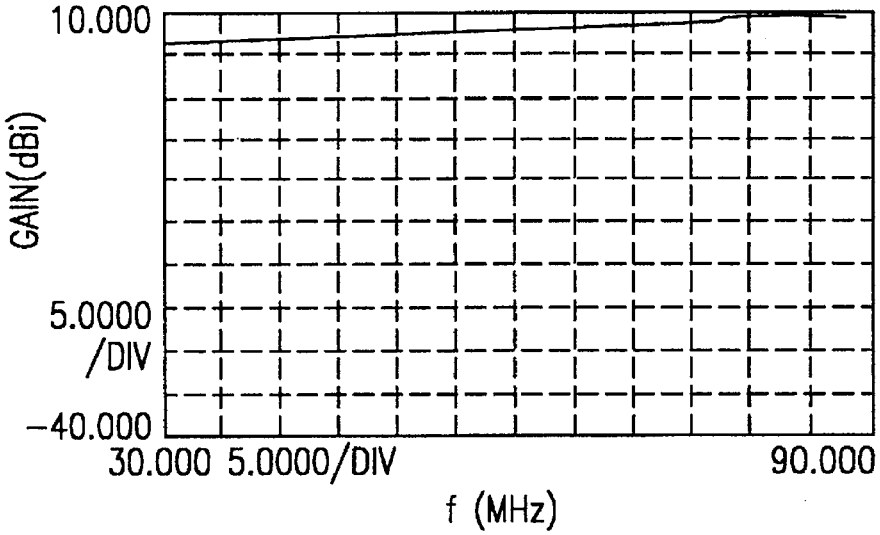
FIG. 10 is a plot showing the gain at the horizon versus the frequency of charge collector equipped, base-isolated, open-sleeve dipole antenna.
Figure 11:
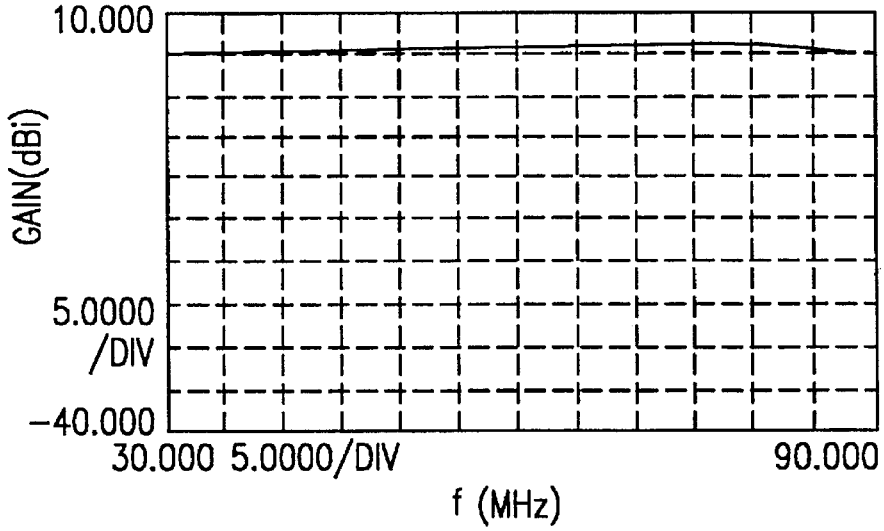
FIG. 11 is a plot of the gain at the horizon versus frequency of the charge collector equipped, open-sleeve monopole.

FIGS. 10 and 11 show a plot of the gain at the horizon versus the frequency range of the antennas. The performance gain for the dipole, positioned 12 inches above the ground plane, exhibits a near flat uniform curve which approaches 10 dBi over the broad frequency range of 30 MHz to 88 MHz. Similarly, FIG. 11 for the open-sleeve, top-loaded monopole antenna provides a flat gain response at the horizon over the same bandwidth.

Figure 12:
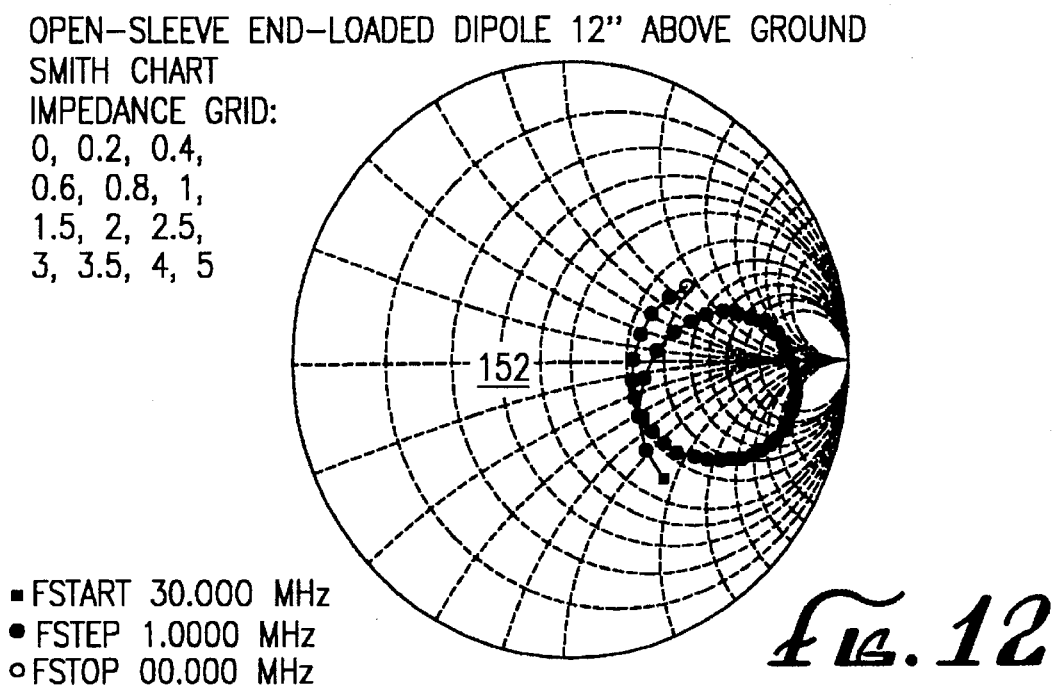
FIG. 12 is a plot showing the impedance of a charge collector equipped, base-isolated open-sleeve dipole.
Figure 13:
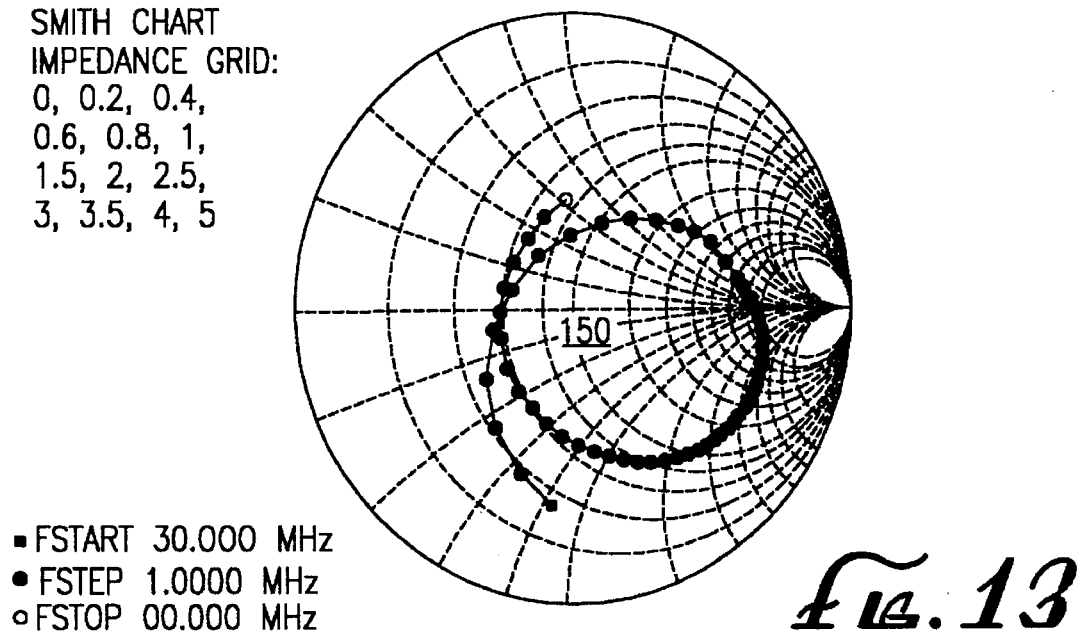
FIG. 13 is a plot showing the impedance of a charge collector equipped, open-sleeve monopole.

Impedance studies of the open-sleeve dipole antenna and of the open-sleeve monopole antenna using a Smith chart at incremental steps of a 1 MHz show that a uniform, smooth curve is generated. The curve in FIG. 12 shows good impedance performance in terms of the curve being uniform and smooth and is located near the geometric center 152 of the Smith chart. FIG. 13 is the impedance of a top-loaded, open-sleeve monopole antenna of this invention, and again is a smooth curve the generally surrounds the geometric center 150 of the Smith chart. In these Smith charts, the geometric center corresponds to 50Ω impedance of the transmission lines. Generally, such Smith chart impedance studies, if unfavorable, would result in a meandering serpentine curve over the area of the chart.

Although the present invention has been described in considerable detail with reference to certain preferred versions thereof, other versions are possible. It is intended to cover all modifications, alternatives and equivalents which may fall within spirit and scope of the invention as defined in the appended claims.

What is claimed is:

1. A broadband antenna capable of transmitting and receiving electromagnetic energy, said antenna being mounted on a support platform and connected to a transmission line, said antenna comprising:

radiating means for receiving and radiating electromagnetic energy and formed of elongated structures, said radiating means equipped with a feed point and having one or more free ends;

charge collecting means for collecting electrical charges affixed to at least one of said free ends creating a current sink for collecting current generated by said radiating means;

feed means for conducting electromagnetic to and from the feed point of said radiating means;

sleeve means for enhancing the instantaneous band width of said radiating means, said sleeve means being constructed of a pair of spaced apart longitudinal cylinder sections encircling said free ends forming an open sleeve structure and being coaxially aligned with and extending part way along said radiating means, whereby the impedance of said radiating means approximate the impedance of the transmission line.

2. The broadband antenna as claimed in claim 1 including isolation choke means for isolating the radiating means against the electrical disturbances caused by said platform.

3. The broadband antenna as claimed in claim 1 wherein the radiating means is a monopole.

4. The broadband antenna as claimed in claim 1 wherein the antenna is a dipole antenna.

5. The broadband antenna as claimed in claim 1 wherein the charge collecting means is formed of conductive members extending radially from the free end of the radiating means forming an umbrella-like structure.

6. The broadband antenna as claimed in claim 1 wherein the antenna is a monopole and the feed means is located at the end of the radiating means opposite the free end to which the charge collecting means is attached.

7. The broadband antenna as claimed in claim 1 wherein the antenna is a dipole and the feed point is located generally at the center of the dipole between the charge collecting means.

8. A broadband dipole antenna mounted on a support platform and connected to a transmission line, said antenna capable of transmitting and receiving electromagnetic energy, said antenna further comprising:

a pair of radiating elements for receiving and transmitting electromagnetic energy and formed of elongated tubular structures each having free ends, said radiating elements being coaxially aligned and each being mechanically coupled at one of their free ends with a dielectric support element holding the elements in spaced apart aligned relationship forming thereby a central location for said radiating elements;

charge collecting means for collecting electrical charge affixed to the remaining free ends of said radiating elements creating a current sink at each such free ends for collecting current generated by said radiating elements;

feed means for conducting electromagnetic energy to and from the remaining free ends of the radiating elements;

sleeve means for enhancing the instantaneous bandwidth of said elements, said sleeve means being constructed of a pair of spaced apart longitudinal cylinder sections disposed circumferentially about and parallel to said radiating elements forming an open sleeve structure radially spaced from the radiating elements;

isolation choke means coupled to said radiating elements for isolating the radiating elements against electrical disturbances caused by said platform, said isolating choke means including a coaxial cable wound about a non-conductive core wherein an approximate impedance match is maintained between said radiating elements and the transmission line.

9. The dipole antenna as claimed in claim 8 wherein said isolation choke means is coupled to the free end of one of the radiating elements opposite the feed point of said dipole antenna.

10. The dipole antenna as claimed in claim 8 wherein said isolation choke means is coupled to said radiating elements at a location coincident with said feed point.

11. The dipole antenna as claimed in claim 8 wherein the core of said isolation choke means consists of a ferrite material.

12. The dipole antenna as claimed in claim 8 wherein the isolation choke means has an operating impedance of at least 1000 ohms.

* * * * *